US009988186B1

(12) United States Patent
Johnson

(10) Patent No.: US 9,988,186 B1
(45) Date of Patent: Jun. 5, 2018

(54) TOOL STORAGE DEVICE

(71) Applicant: Mark D. Johnson, Sioux Falls, SD (US)

(72) Inventor: Mark D. Johnson, Sioux Falls, SD (US)

( * ) Notice: Subject to any disclaimer, the term of this patent is extended or adjusted under 35 U.S.C. 154(b) by 0 days. days.

(21) Appl. No.: 15/364,438

(22) Filed: Nov. 30, 2016

(51) Int. Cl.

| | |
|---|---|
| ***B65D 25/22*** | (2006.01) |
| ***B25H 3/02*** | (2006.01) |
| ***B25H 3/06*** | (2006.01) |
| ***B65D 25/28*** | (2006.01) |

(52) U.S. Cl.
CPC ..... *B65D 25/22* (2013.01); *B25H 3/02* (2013.01); *B25H 3/06* (2013.01); *B65D 25/2811* (2013.01)

(58) Field of Classification Search
CPC ..... B65D 25/22; B25H 3/02; B25H 3/06
USPC ..... 211/90.01, 113; 248/693, 689; 312/101, 312/237, 351.1, 351.14
See application file for complete search history.

(56) References Cited

U.S. PATENT DOCUMENTS

| | | | | |
|---|---|---|---|---|
| D550,007 | S * | 9/2007 | Westra | D6/514 |
| 7,367,571 | B1 | 5/2008 | Nichols | |
| 8,448,959 | B1 * | 5/2013 | Pohot | B25H 3/02 280/47.131 |
| 8,925,683 | B1 * | 1/2015 | Gunsaullus | E06C 1/38 182/129 |
| 2005/0067361 | A1 | 3/2005 | Waymire | |
| 2006/0021985 | A1 | 2/2006 | Jasper | |

FOREIGN PATENT DOCUMENTS

| | | |
|---|---|---|
| CN | 201932887 | 8/2011 |
| CN | 201225908 | 4/2013 |
| CN | 103232014 | 5/2013 |
| DE | 201120003956 | 8/2011 |

* cited by examiner

*Primary Examiner* — Michael Safavi

(57) ABSTRACT

A tool storage device stores tools and provides a work surface attachable to a railing of a lift. The device includes a top wall extending from a front side of a box to define a seat with a front side of the box. The seat abuts a railing on a lift such that the box is supported on and positioned against the railing. Each of a pair of tethers is elongated and coupled to the box for extending around the railing and being secured to hold the box to the railing. A front opening into an interior space of the box provides access to the interior space to a person supported on the lift.

13 Claims, 3 Drawing Sheets

TOOL STORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing tools and providing a work surface attachable to a railing of a lift.

BRIEF SUMMARY OF THE INVENTION

An embodiment of the disclosure meets the needs presented above by generally comprising a top wall extending from a front side of a box to define a seat with a front side of the box. The seat abuts a railing on a lift such that the box is supported on and positioned against the railing. Each of a pair of tethers is elongated and coupled to the box for extending around the railing and being secured to hold the box to the railing. A front opening into an interior space of the box provides access to the interior space to a person supported on the lift.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
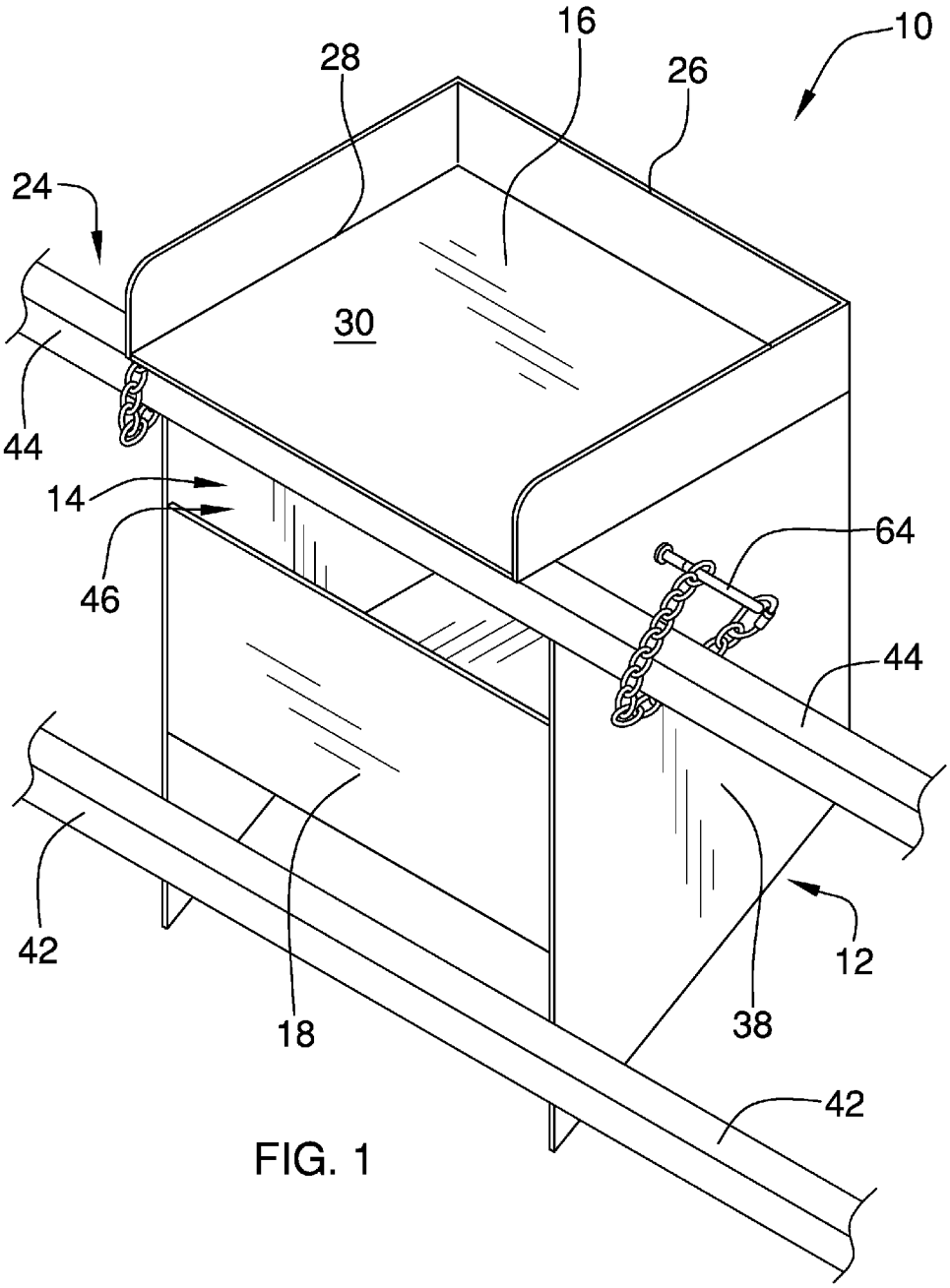
FIG. 1 is a top front side perspective view of a tool storage device according to an embodiment of the disclosure.
Figure 2:
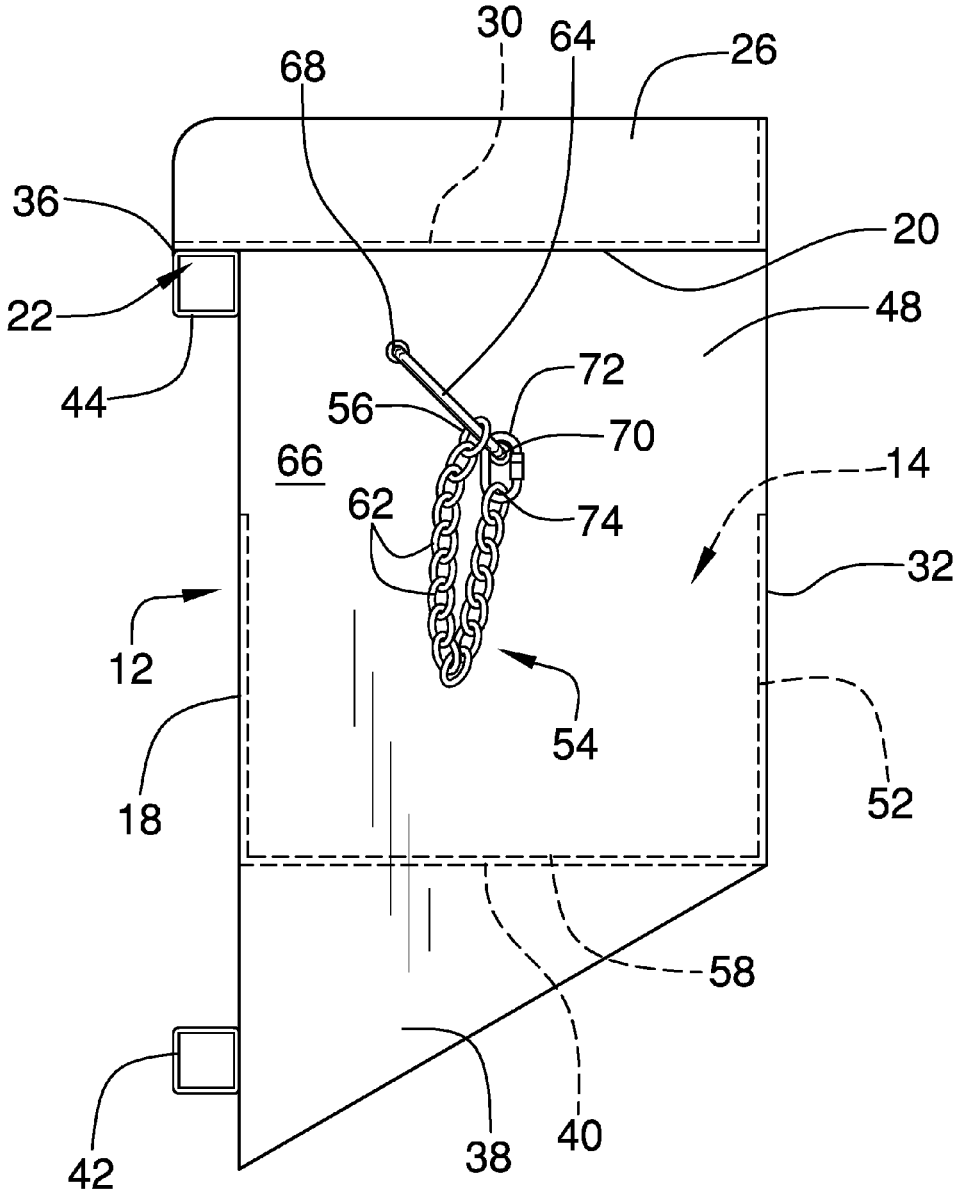
FIG. 2 is a side view of an embodiment of the disclosure.
Figure 3:
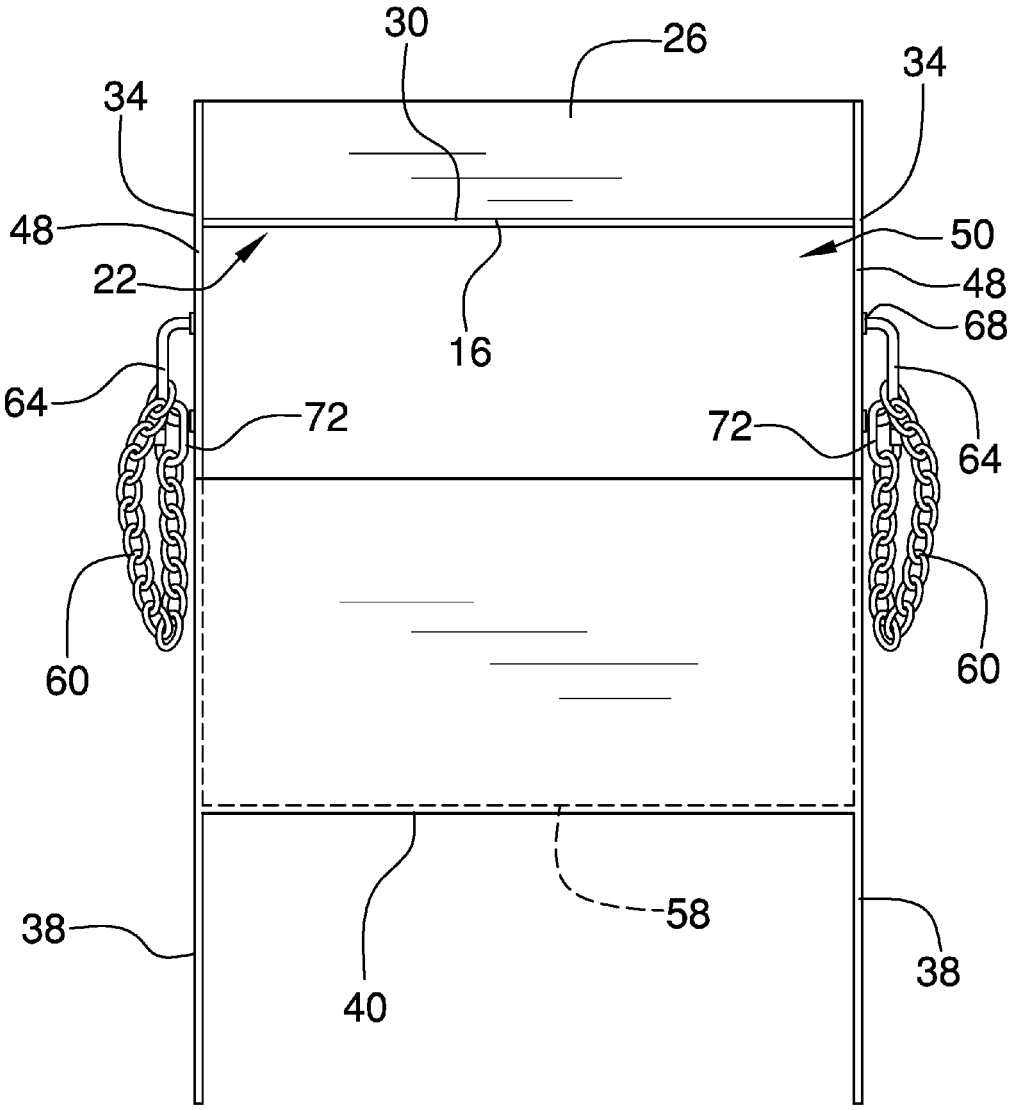
FIG. 3 is a front view of an embodiment of the disclosure.

With reference now to the drawings, and in particular to FIGS. 1 through 3 thereof, a new storage device embodying the principles and concepts of an embodiment of the disclosure and generally designated by the reference numeral 10 will be described.

As best illustrated in FIGS. 1 through 3, the tool storage device 10 generally comprises a box 12 defining an interior space 14. A top wall 16 of the box 12 extends forwardly from a front side 18 of the box 12 wherein a bottom surface 20 of the top wall 16 extends from the front side 18 to define a seat 22 with the front side 18 of the box 12. The seat 22 is configured for abutting a railing 24 on a lift such that the box 12 is supported on and positioned against the railing 24. A lip 26 extends up from a peripheral edge 28 of the top wall 16 of the box 12 wherein the lip 26 at least partially surrounds an upper surface 30 of the top wall 16. The lip 26 extends around a back side 32 and forwardly from the back side 32 towards the front side 18 along lateral sides 34 of the top wall 16. A front edge 36 of the top wall 16 is left open to facilitate access to the upper surface 30 of the top wall 16.

Each of a pair of extensions 38 extends downwardly from a bottom edge 40 of the box 12 defined by a bottom wall 58 wherein the extensions 38 are configured for abutting a lower rail 42 of the railing 24 while the seat 22 receives and abuts a top rail 44 of the railing 24.

A front opening 46 into the interior space 14 extends through the front side 18 of the box 12 wherein the front opening 46 is configured to provide access to the interior space 14 to a person supported on the lift. The front opening 46 is adjacent to and extending downwardly from the top wall 16. The front opening 46 extends a full width between a pair of side panels 48 of the box 12. Similarly, a rear opening 50 extends through a rear wall 52 of the box 12. The rear opening 50 is adjacent to and extends downwardly from the top wall 16. The rear opening 50 extends a full width between the pair of side panels 48 of the box 12.

Each of a pair of tethers 54 is elongated having a first end 56 coupled to the box 12 wherein each tether 54 extends from the box 12 and is configured for extending around the railing 24 and being secured such that the tethers 54 hold the box 12 to the railing 24. Each tether 54 is a chain 60 having a plurality of links 62. The chain 60 may be 60-grade chain or the like.

Each of a pair of handles 64 is coupled to an associated one of the pair of side panels 48 of the box 12. Each handle 64 is attached to an exterior face 66 of the side panel 48 and extends outwardly away from the box 12. The first end 56 of each of the tethers 54 is coupled to an associated one of the handles 64. Each of the handles 64 has an upper end 68 and a lower end 70. Each of the handles 64 is angled relative to the upper surface 30 of the top wall 16 such that the upper end 68 of each of the handles 64 is positioned proximate to the front side 18 and the top wall 16 and each handle 64 extends simultaneously downward and away from the top wall 16 and rearwardly away from the front side 18. Each of a pair of carabiners 72 is coupled to a second end 74 of an associated one of the tethers 54 wherein each carabiner 72 is selectively couplable to an associated one of the handles 64 for securing the associated tether 54 to the associated handle 64. Each carabiner 72 may be rated to hold a minimum of 1000 pounds.

The upper surface 30 of the top wall 16 may have a depth between 15 centimeters and 25 centimeters. The width may be between 30 centimeters and 50 centimeters. The height of the device 10 including the lip 26 may be between 65 centimeters and 80 centimeters.

In use, the railing 24 is positioned in the seat 22 and the extensions 38 abut the railing 24 such that the box 12 is positioned against the railing 24. The front opening 46 is exposed through the railing 24 making the interior space 14 accessible to any person on the lift. The carabiners 72 are detached from the handles 64 and the chain 60 is extended around the railing 24. The carabiners 72 are then secured on the respective handles 64 such that the seat 22 cannot be disengaged from the railing 24 until the tethers 54 are removed from the railing 24. The upper surface 30 of the top wall 16 is positioned at the railing 24 for use as a work surface and the lip 26 prevents objects from falling from the top wall 16 and off of the lift.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tool storage device comprising:

a box defining an interior space, said box having a front side;

a top wall of said box extending from said front side wherein a bottom surface of said top wall extends from said front side to define a seat with said front side of said box, and wherein said seat is configured for abutting a railing on a lift such that said box is supported on and positioned against said railing;

a pair of tethers, each tether being elongated and having a first end coupled to said box wherein each tether extends from said box and is configured for extending around the railing and being secured such that said tethers are configured for holding said box to the railing;

a front opening which opens into said interior space and extends through said front side of said box wherein said front opening is configured to provide access to said interior space to a person supported on the lift; and a lip extending up from a peripheral edge of said top wall of said box, said lip extending around a back side of said peripheral edge and forwardly from said back side along lateral sides of said peripheral edge towards a front side of said peripheral edge whereby said lip partially surrounds an upper surface of said top wall, and wherein said front side of said peripheral edge is left open facilitating access to an upper surface of said top wall.

2. The device of claim 1, further comprising a pair of handles, each of said handles being coupled to an associated one of a pair of side panels of said box.

3. The device of claim 2, wherein said first end of each of said tethers is coupled to an associated one of said handles.

4. The device of claim 2, wherein each of said handles has an upper end and a lower end, each of said handles being angled relative to said upper surface of said top wall such that said upper end of each of said handles is positioned proximate to said front side and said top wall and each said handle extends simultaneously downward and away from said top wall and rearwardly away from said front side.

5. The device of claim 1, further comprising a pair of extensions, each of said extensions extending downwardly from a bottom edge of said box wherein said extensions are configured for abutting a lower rail of said railing while said seat receives and abuts a top rail of said railing.

6. The device of claim 1, wherein said front opening is adjacent to and extending downwardly from said top wall.

7. The device of claim 1, wherein said front opening extends a full width between a pair of side panels of said box.

8. The device of claim 1, further comprising a rear opening extending through a rear wall of said box.

9. The device of claim 8, wherein said rear opening is adjacent to and extending downwardly from said top wall.

10. The device of claim 8, wherein said rear opening extends a full width between a pair of side panels of said box.

11. The device of claim 1, wherein each said tether is a chain having a plurality of links.

12. The device of claim 11, further comprising a pair of carabiners, each said carabiner being coupled to a second end of an associated one of said tethers wherein each carabiner is selectively couplable to an associated one of said handles for securing said associated tether to said associated handle.

13. A tool storage device comprising:

a box defining an interior space, said box having a front side;

a top wall of said box extending from said front side wherein a bottom surface of said top wall extends from said front side to define a seat with said front side of said box, and wherein said seat is configured for abutting a railing on a lift such that said box is supported on and positioned against said railing;

a pair of extensions, each of said extensions extending downwardly from a bottom edge of said box wherein said extensions are configured for abutting a lower rail of said railing while said seat receives and abuts a top rail of said railing;

a front opening which opens into said interior space and extends through said front side of said box wherein said front opening is configured to provide access to said interior space to a person supported on the lift, said front opening being adjacent to and extending downwardly from said top wall, said front opening extending a full width between a pair of side panels of said box;

a rear opening extending through a rear wall of said box, said rear opening being adjacent to and extending downwardly from said top wall, said rear opening extending a full width between a pair of side panels of said box;

a lip extending up from a peripheral edge of said top wall of said box, said lip extending around a back side of said peripheral edge and forwardly from said back side along lateral sides of said peripheral edge towards a front side of said peripheral edge whereby said lip partially surrounds an upper surface of said top wall, and wherein said front side of said peripheral edge is left open facilitating access to an upper surface of said top wall;

a pair of tethers, each tether being elongated and having a first end coupled to said box wherein each tether extends from said box and is configured for extending around the railing and being secured such that said tethers are configured for holding said box to the railing, each said tether being a chain having a plurality of links;

a pair of handles, each of said handles being coupled to an associated one of a pair of side panels of said box, said first end of each of said tethers being coupled to an associated one of said handles, each of said handles having an upper end and a lower end, each of said handles being angled relative to said upper surface of said top wall such that said upper end of each of said handles is positioned proximate to said front side and said top wall and each said handle extends simultaneously downward and away from said top wall and rearwardly away from said front side; and a pair of carabiners, each said carabiner being coupled to a second end of an associated one of said tethers wherein each carabiner is selectively couplable to an associated one of said handles for securing said associated tether to said associated handle.

* * * * *